US007403090B2

(12) United States Patent
Kita

(10) Patent No.: US 7,403,090 B2
(45) Date of Patent: Jul. 22, 2008

(54) CHARACTERISTIC ADJUSTMENT METHOD FOR INDUCTOR AND VARIABLE INDUCTOR

(75) Inventor: Yukihiro Kita, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 287 days.

(21) Appl. No.: 11/405,122

(22) Filed: Apr. 13, 2006

(65) Prior Publication Data

US 2007/0018768 A1 Jan. 25, 2007

(30) Foreign Application Priority Data

Jul. 25, 2005 (JP) ..... 2005-213755

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 6,114,938 A * 9/2000 Iida et al. ..... 336/200
6,124,779 A * 9/2000 Yamamoto ..... 336/200
6,369,684 B1 * 4/2002 Iida et al. ..... 336/200
6,583,704 B2 * 6/2003 Iida et al. ..... 336/200
6,621,141 B1 * 9/2003 Van Schuylenbergh et al. .... 257/531
6,720,639 B2 * 4/2004 Lemaire ..... 257/531
6,856,499 B2 * 2/2005 Stokes ..... 361/277
7,071,806 B2 * 7/2006 Masu et al. ..... 336/200

FOREIGN PATENT DOCUMENTS

JP 08-162331 6/1996
JP 08306534 A * 11/1996
JP 09-153411 6/1997
JP 09153411 A * 6/1997
JP 09232144 A * 9/1997

* cited by examiner

*Primary Examiner*—Anh T Mai
(74) *Attorney, Agent, or Firm*—Volentine & Whitt, PLLC

(57) ABSTRACT

The invention is applicable to a characteristic adjustment method for an inductor formed by laminating a plurality of coils and electrically connecting these coils by a through hole, and is aimed at providing a method which can easily adjust the characteristic of the inductor with a simple configuration. The method comprises determining a part of the coil in an outermost layer as an adjustment area, and not forming the through hole below the adjustment area, and removing at least a part of the adjustment area after the coil in the outermost layer is formed.

7 Claims, 5 Drawing Sheets

CHARACTERISTIC ADJUSTMENT METHOD FOR INDUCTOR AND VARIABLE INDUCTOR

CROSS REFERENCE TO RELATED APPLICATION

This application claims the priority of Application No. 2005-213755, filed on Jul. 25, 2005 in Japan, the subject matter of which is incorporated herein by reference.

TECHNICAL FIELD OF THE INVENTION

The present invention relates to, for example, a variable inductor used for a signal transfer circuit.

BACKGROUND OF THE INVENTION

A semiconductor integrated circuit using a conventional inductor includes, for example, the one shown in the Institute of Electronics, Information and Communication Engineers, Technical Report of IEICE, Vol. 93, No. 416, pp. 43 to 48 (1993). Since a spiral inductor shown in the paper can be formed on the same substrate together with a gallium arsenic high electron mobility transistor (GaAs HEMT), a low-noise preamplifier and the like built into a matching circuit having the spiral inductor have been realized.

[Non-patent document 1] The Institute of Electronics, Information and Communication Engineers, Technical Report of IEICE, Vol. 93, No. 416.

The inductor characteristic changes due to reasons such as the shape thereof and a difference in the process. For example, there may be a problem such that when the inductor is used in a signal transfer circuit, the inductor characteristic is shifted from an optimum value in a target frequency, thereby causing a decrease in receiver sensitivity. Such a problem becomes noticeable when the frequency is high. The inductor characteristic can be brought close to the optimum value to some extent by adjusting an applied bias, but there is a limitation.

In electronic equipment for which miniaturization is required, particularly, in mobile communication equipment such as a mobile phone and a car phone, miniaturization is also required for the parts used therein. Moreover, as the operation frequency increases, the circuit becomes more complicated, and hence, narrow deviation is required for the parts used therein. Actually, however, there is a deviation in the individual parts, and a circuit constituted by mounting these parts may not function. Accordingly, a method in which variable type parts are used for a part of parts group constituting the circuit, and the variable type parts are finely adjusted so as to make the circuit function has been employed. As one method, there is a case in which a variable inductor is used.

In a variable inductor disclosed in Japanese Unexamined Patent Publication No. Hei 8-162331, a plurality of looped conductors having an open end is provided in the vicinity of a spiral conductor, and an opening or short-circuiting switch is provided respectively to the open ends. It is explained therein that as a result, the inductance of the inductor decreases.

On the other hand, in the inductor disclosed in Japanese Unexamined Patent Publication No. Hei 9-153411, a first conductor pattern formed of two spiral conductor patterns and a first magnetic film covering the first conductor pattern are formed on one surface of an insulating substrate, and a second conductor pattern formed of two spiral conductor patterns and at least a second conductor pattern of a second magnetic film covering the second conductor pattern are formed on the other surface of the insulating substrate, and the conductor patterns on the opposite surfaces are connected to each other to form one coil, and by cutting the magnetic film, the inductance value is changed and adjusted.

[Patent Document 1] Japanese Unexamined Patent Publication No. Hei 8-162331

[Patent Document 2] Japanese Unexamined Patent Publication No. Hei 9-153411

In the above described conventional art, however, the circuit configuration including the coil becomes complicated.

OBJECTS OF THE INVENTION

Accordingly, an object of the present invention is to provide a method which can easily adjust the characteristic of the inductor with a simple configuration.

Another object of the present invention is to provide a variable inductor which can easily adjust the characteristic of the inductor with a simple configuration.

Additional objects, advantages and novel features of the present invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

A first aspect of the present invention is applied to a characteristic adjustment method for an inductor formed by laminating a plurality of coils and electrically connecting these coils by a through hole. The method comprises determining a part of the coil in an outermost layer as an adjustment area, and not forming the through hole below the adjustment area, and removing at least a part of the adjustment area after the coil in the outermost layer is formed.

A variable inductor according to a second aspect comprises: a first spiral coil formed of a conductive material; a second spiral coil formed of a conductive material; an insulating layer interposed between the first and the second coils; and a through hole formed in the insulating layer for electrically connecting the first and the second coils. The first coil includes an adjustment area which is removed for adjusting the characteristic of the inductor after the first coil has been formed. Moreover, the through hole is not formed below the adjustment area.

In the present invention, the adjustment area is preferably set in the outermost circumference of the spiral of the coil in the outermost layer. Moreover, the adjustment area can include at least one area inside of the outermost circumference. The adjustment area can be removed by focused ion beams.

If a cutting length in the adjustment area is made longer, a decreasing proportion of the inductance value and the Q value increases. On the other hand, if the cutting length is made shorter, the decreasing proportion of the inductance value and the Q value decreases. Moreover, if a cutting position is set at a position close to the center (inside) of the spiral coil, the decreasing proportion of the inductance value and the Q value increases. On the other hand, if the cutting position is set at a position far from the center (outside) of the spiral coil, the decreasing proportion of the inductance value and the Q value decreases. Based on these principles, the length, position, and number of the adjustment areas (cutting area) are appropriately set.

The variable inductor according to the present invention can be applied to a transfer circuit in radio communication such as in a GPS, mobile phone, and wireless LAN, and used, for example, in an amplifier and an oscillator. The present invention is particularly preferable for a radio communication transfer circuit for a high frequency area. As the characteristic adjusted by the present invention, various characteristics such as the gain of the amplifier and the noise factor (NF) are included as well as the inductance and the Q value.

According to the present invention, the characteristics of the inductor can be easily adjusted with a simple configuration.

BRIEF DESCRIPTION OF THE DRAWINGS

FIG. 2 depicts a sectional structure of the variable inductor according to the embodiment, wherein FIG. 2A is a cross section along line A-A in FIG. 1, and FIG. 2B is a cross section along line B-B in FIG. 1;

DETAILED DISCLOSURE OF THE INVENTION

In the following detailed description of the preferred embodiments, reference is made to the accompanying drawings which form a part thereof, and in which is shown by way of illustration specific preferred embodiments in which the invention may be practiced. These preferred embodiments are described in sufficient detail to enable those skilled in the art to practice the invention, and it is to be understood that other preferred embodiments may be utilized and that logical, mechanical and electrical changes may be made without departing from the spirit and scope of the present invention. The following detailed description is, therefore, not to be taken in a limiting sense, and scope of the present inventions is defined only by the appended claims.

Figure 1:
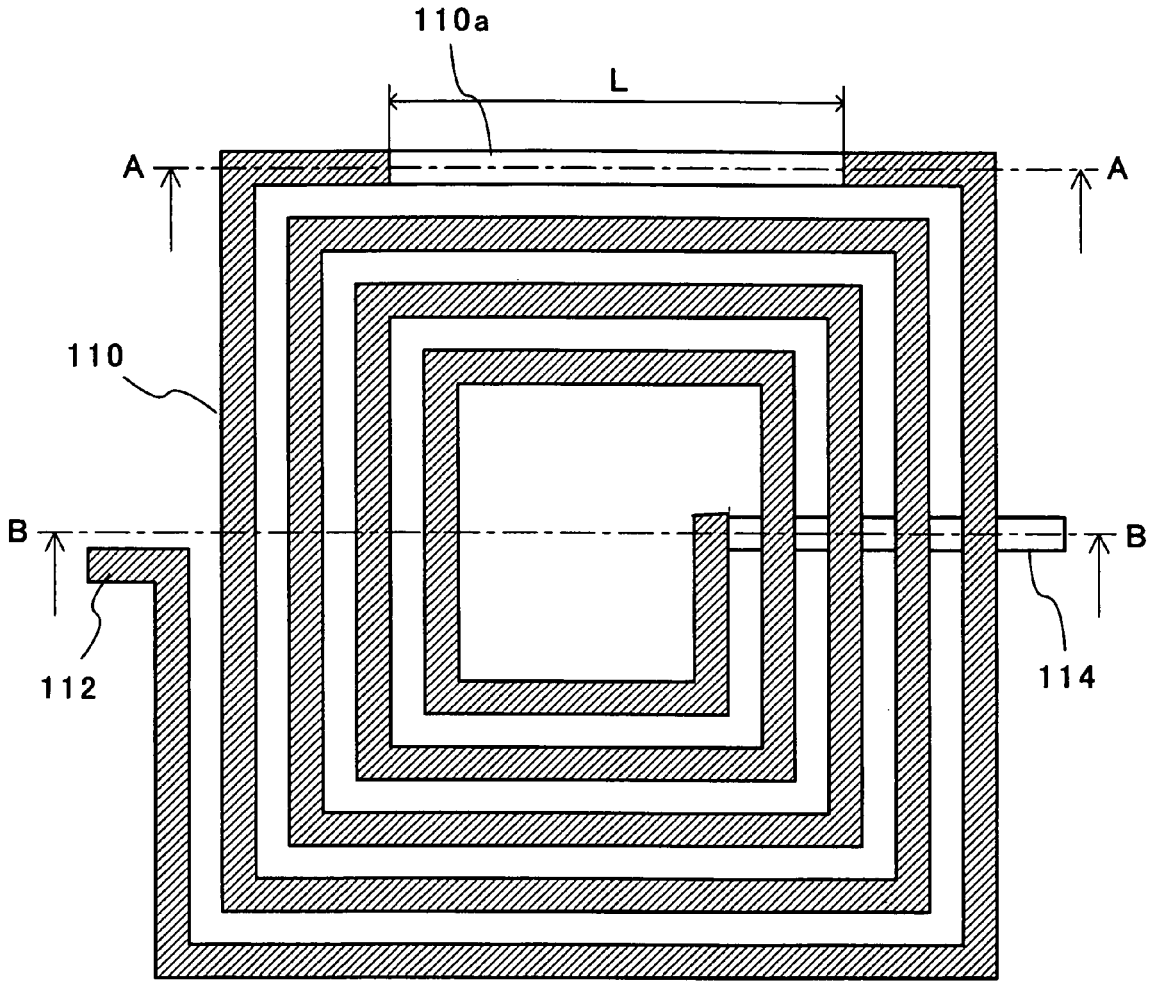
FIG. 1 is a plan view showing the structure of a variable inductor according to an embodiment of the present invention.
Figure 2:
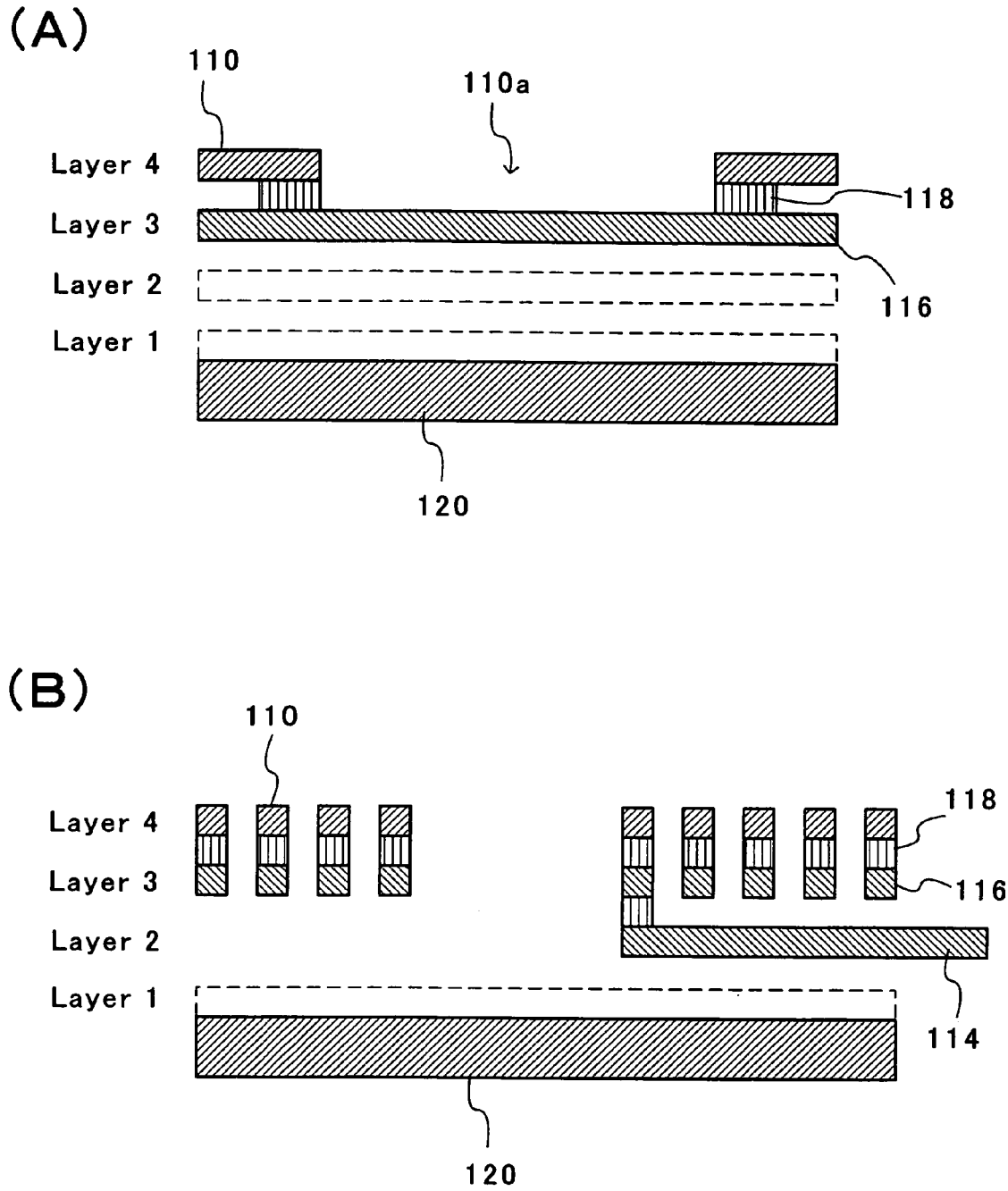

A best mode for carrying the invention will be specifically explained by way of examples. FIG. 1 is a plan view showing the structure of a variable inductor according to an embodiment of the present invention. FIG. 2 depicts a sectional structure of the variable inductor according to the embodiment, wherein FIG. 2A is a cross section along line A-A in FIG. 1, and FIG. 2B is a cross section along line B-B in FIG. 1. The structure of the variable inductor in the embodiment will be explained first. The variable inductor according to the embodiment is mainly formed in third and fourth wiring layers of first to fourth metal wiring layers laminated on a semiconductor substrate 120 via an insulating layer (not shown). An input/output line 114 connected to a spiral coil 116 formed in the third wiring layer is formed in a second wiring layer. An input/output line 112 on the other side is formed by an outside end of a spiral coil 110 formed in the fourth wiring layer. The number of lamination of the coils is not limited to two layers, and one layer or three layers or more may be used.

The two spiral coils 110 and 116 are respectively, a rectangular spiral coil made of aluminum, copper, or the like, and have substantially the same shape. In the present invention, the shape of the spiral coil is not limited to the rectangular shape, and other shapes such as circular and elliptical shapes may be used. The spiral coils 116 and 110 formed in the third and the fourth wiring layers are electrically connected by a through hole 118 formed in the insulating layer. To be precise, the spiral coils 110 and 116 are electrically connected to each other by a conductive material such as tungsten filled in the through hole. A plurality of through holes 118 is formed over the entire coil at predetermined intervals.

In the spiral coil 110 in the uppermost layer (the fourth wiring layer), an adjustment area 110*a* is set in a part of the outermost circumference. The adjustment area 110*a* is an area to be cut after completion of the inductor (after finishing a wafer process), and the through hole 118 is not formed below the adjustment area 110*a*. A cutting length "L" in the adjustment area 110*a* can be appropriately changed (adjusted) corresponding to a deviation from a target characteristic at the time of a characteristic test after completion of the inductor. In other words, the adjustment area 110*a* is just an area scheduled to be cut, and can be considered as an area, below which the through hole is not formed. The adjustment area can be set on the side closer to the center of the coil (inside of the outermost circumference by at least one winding), as well as or instead of the outermost circumference.

In the spiral coil 110, in the state before the adjustment area 110*a* is cut, the signal is also transmitted to the area 110*a* to act upon a magnetic flux transmitted through the coil. On the other hand, after the adjustment area 110*a* is cut, the signal is not transmitted to the area 110*a*, and hence, the signal does not act upon the magnetic flux transmitted through the coil.

The characteristic adjustment method for the variable inductor in the embodiment will be explained next. In the variable inductor having the above described structure, the inductor characteristic is tested by using a predetermined test machine, after completion of the inductor (after finishing the wafer process). Then based on the test results, the adjustment area 110*a* of the spiral coil 110 is removed (cut down) by using a focused ion beam system (FIB system) or the like. For example, ion beams output from a gallium ion source are focused and irradiated onto the adjustment area 110*a*, and the irradiated part is removed due to an interaction of the ion beams with the coil material. The coil may be selectively removed by a method such as laser-trimming, other than the FIB method.

As described above, when the inductance and the Q value are to be largely decreased, the cutting length "L" in the adjustment area 110*a* is made longer. At the same time or alternatively, the adjustment area (cutting position) is set to a position close to the center (inside) of the spiral coil 110. On the other hand, when the inductance and the Q value are to be slightly decreased, the cutting length "L" in the adjustment area 110*a* is made shorter.

Figure 3:
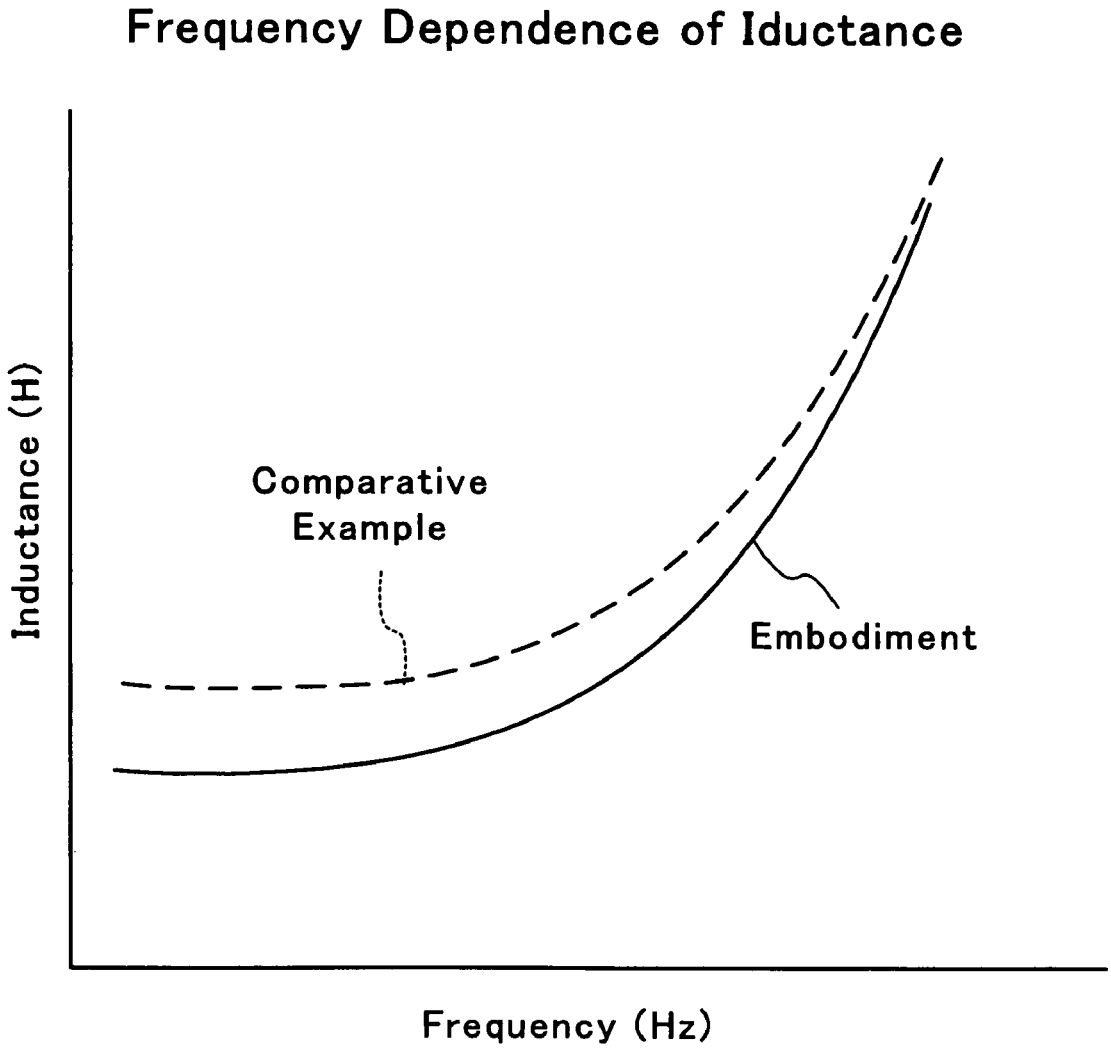
FIG. 3 is a graph showing the operation in the embodiment, showing frequency dependence of an inductance.
Figure 4:
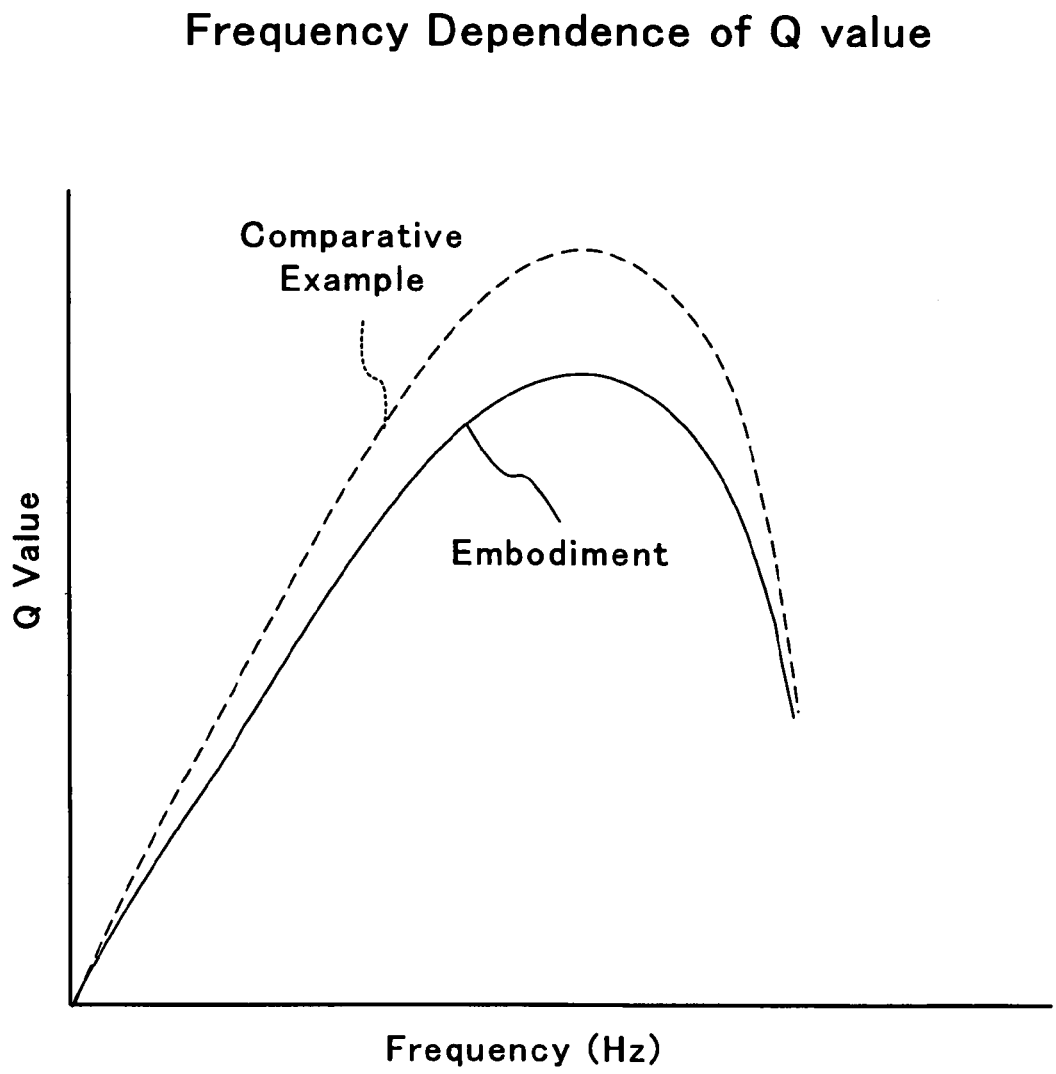
FIG. 4 is a graph showing the operation in the embodiment, showing frequency dependence of a Q value.

FIGS. 3 and 4 respectively depict frequency dependence of the inductance and the Q value. "Comparative example" in the graph indicates a curve at the time of using a conventional inductor in which the coil is not cut, and "embodiment" in the graph indicates a curve when the adjustment area 110*a* is cut. As shown from the graph, in the embodiment, both the inductance and the Q value are made lower than those in the comparative example.

Figure 5:
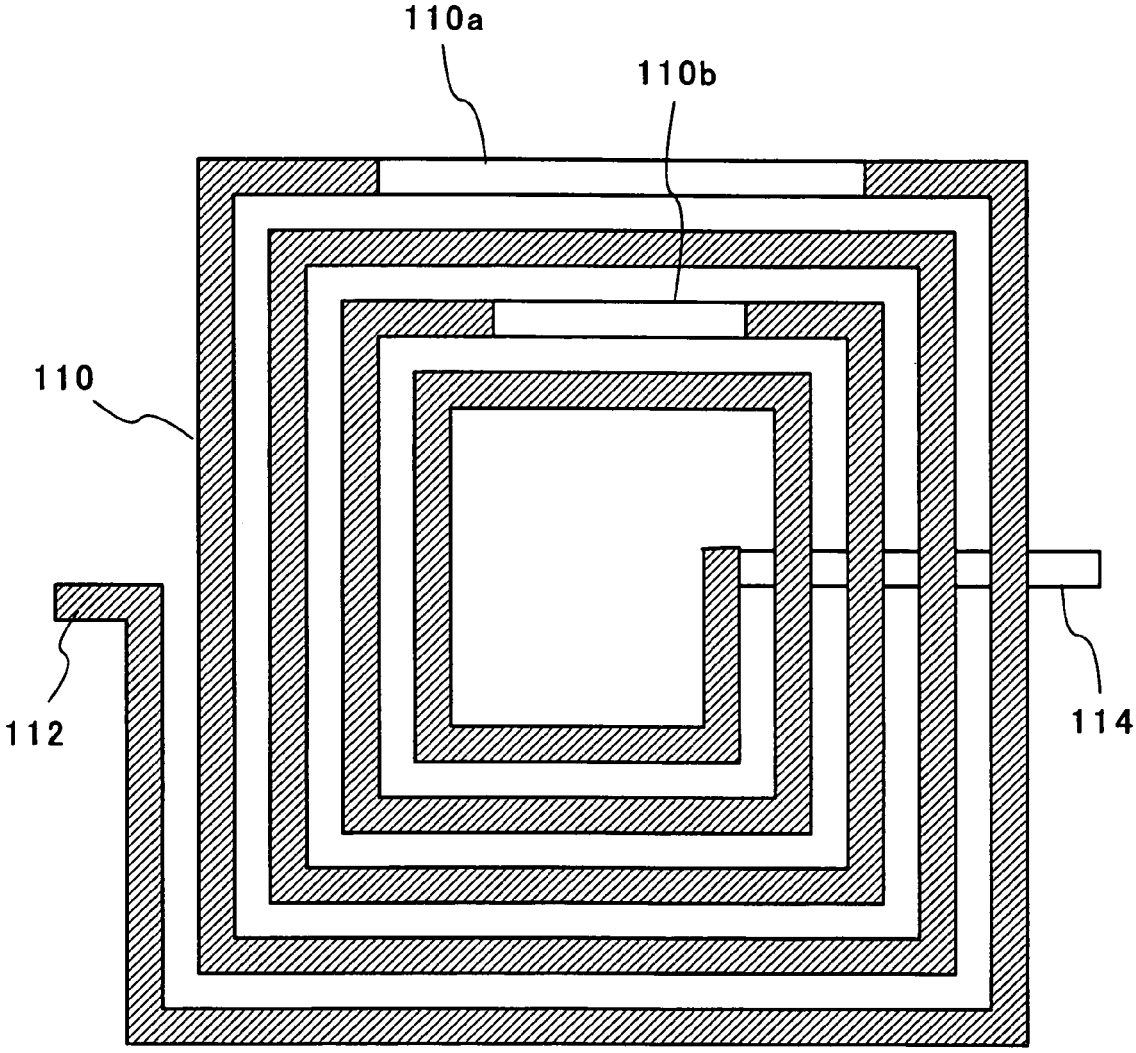
FIG. 5 is a plan view showing the structure of a variable inductor according to another embodiment of the present invention.

FIG. 5 is a plan view showing the structure of a variable inductor according to another embodiment of the present invention, wherein another adjustment area 110*b* is set at a position close to the center (inside) of the spiral coil 110. The inductance and the Q value can be decreased relatively largely by cutting the coil in the adjustment area 110*b*. This example is effective when the coil-forming area is small and the adjustment area 110*a* in the outermost circumference cannot be made long.

Embodiments of the present invention have been explained above, but the present invention is not limited thereto, and design changes which do not depart from the technical concept described in the appended claims are possible.

What is claimed is:

1. A characteristic adjustment method for an inductor formed by laminating a plurality of coils and electrically connecting these coils by a through hole, comprising:

determining a part of the coil in an outermost layer as an adjustment area, and not forming said through hole below said adjustment area; and removing at least a part of said adjustment area after the coil in said outermost layer is formed.

2. A characteristic adjustment method for an inductor according to claim 1, wherein said adjustment area includes a first area in an outermost circumference of a spiral of a coil in said outermost layer.

3. A characteristic adjustment method for an inductor according to claim 1, wherein said adjustment area includes a second area inside of the outermost circumference of the spiral of the coil in said outermost layer by at least one winding.

4. A characteristic adjustment method for an inductor according to claim 1, wherein said adjustment area is removed by focused ion beams.

5. A variable inductor comprising:

a first spiral coil made of a conductive material;

a second spiral coil made of a conductive material;

an insulating layer interposed between said first and second coils; and a through hole formed in said insulating layer for electrically connecting said first and second coils, wherein said first coil has an adjustment area which defines an area to be removed for adjusting the characteristic of the inductor after said first coil has been formed, and said through hole is not formed below said adjustment area.

6. A variable inductor according to claim 5, wherein said adjustment area is defined in an outermost circumference of a spiral of the coil in an outermost layer.

7. A variable inductor according to claim 5, wherein said adjustment area includes a second area inside of the outermost circumference of the spiral of the coil in an outermost layer by at least one winding.

* * * * *